US005812905A

United States Patent [19]

Yoo

[11] Patent Number: 5,812,905

[45] Date of Patent: Sep. 22, 1998

[54] METHOD AND APPARATUS FOR CONTROLLING A CHARGE VOLTAGE OF AN OPC DRUM TO BE AN OPTIMUM VALUE

[75] Inventor: Yong-Baek Yoo, Suwon, Rep. of Korea

[73] Assignee: SamSung Electronics Co., Ltd., Suwon, Rep. of Korea

[21] Appl. No.: 818,889

[22] Filed: Mar. 17, 1997

[30] Foreign Application Priority Data

Mar. 15, 1996 [KR] Rep. of Korea ..... 6941/1996

[51] Int. Cl.[6] ..... G03G 15/02

[52] U.S. Cl. ..... 399/50; 361/221; 361/225; 399/176

[58] Field of Search ..... 399/50, 174–176; 361/220, 221, 225

[56] References Cited

U.S. PATENT DOCUMENTS 5,159,388 10/1992 Yoshiyama et al. ..... 399/50 X 5,420,671 5/1995 Kisu et al. ..... 399/174

5,457,522 10/1995 Haneda et al. ..... 361/225 X

*Primary Examiner*—William J. Royer

*Attorney, Agent, or Firm*—Robert E. Bushnell, Esq.

[57] ABSTRACT

A method and apparatus for controlling a charge voltage of an organic photoconductive (OPC) drum in an electrophotographic image forming device, which are to improve the quality of the image by charging the OPC drum surface uniformly independent of voltage deviation between the OPC drum and the charging roller, the ambient temperature and humidity of the image forming device. This apparatus is comprised of a detector for measuring a ground current flowing through a ground of the OPC drum, a comparator for comparing the measured ground current and preset voltage-related information, and a controller for deriving an optimum voltage for charging the OPC drum based on the resultant of comparison.

17 Claims, 4 Drawing Sheets

*(Exemplary Art)*

METHOD AND APPARATUS FOR CONTROLLING A CHARGE VOLTAGE OF AN OPC DRUM TO BE AN OPTIMUM VALUE

CLAIM OF PRIORITY

This application makes reference to, incorporates the same herein, and claims all benefits accruing under 35 U.S.C §119 from an application entitled Method And Apparatus For Controlling Charge Voltage Of An Opc Drum In An Electrophotogrhic Image Forming Device To Be An Optimum Value earlier filed in the Korean Industrial Property Office on 15 Mar. 1996, and there duly assigned Ser. No. 96-6941 by that Office.

BACKGROUND OF THE INVENTION

1. Field of the Invention

The present invention relates generally to a method and apparatus for controlling a charge voltage of an organic photoconductive (OPC) drum in an electrophotographic image forming device, and more particularly relates to a method and apparatus for charging the OPC drum surface uniformly without dependence of voltage difference of the surface of the OPC drum, the ambient temperature and humidity of the image forming device, improving the quality of the image.

2. Description of the Related Art

There has been generally known two methods for charging an OPC drum of an electrophotographic image forming device: one is scorotion charging, another is charging roller contact charging.

The former is to attach a varistor or zener diode to the grid so as to maintain the potential of the OPC drum at a constant value. This however brings relatively serious problems that a large quantity of ozone is generated by corona discharge and a distorted image is also generated by contamination of the corona generating coil.

The latter is a method in which the voltage is firstly supplied to a rotational shaft of a charging roller in contact with an OPC drum and then the surface of the OPC drum is charged by the rotating charging roller. This has been popularly applied to image forming devices since generating a little ozone and requiring a low supply voltage compared with the scorotion method. A typical electrophotographic image forming device using the contact charging method comprises a rotatable OPC drum and image forming units are arranged around the OPC drum. These image forming units include a charging roller, or charging brush, for charging the surface of the OPC drum with a high negative voltage; an exposing device for applying light from an LED (light emitting diode), or a laser diode, to the charged surface of the OPC drum; a developing roller arranged in rotatable contact with the OPC drum for supplying toner to the electrostatic latent image to be changed into a visible image; and a transferring roller arranged in rotatable contact with the OPC drum for transferring the toner image to paper.

Such electrophotographic image forming devices are operated on the basis of the following principle. When a voltage of −1.35 to −1.45 KV is supplied to a rotational shaft of the charging roller, for example, in contact with the OPC drum, an electric field is formed between the OPC drum and the charging roller thereby inducing an electric charge on the peripheral surface of the OPC drum. The charged area of the OPC drum is then erased partially by light radiated from the exposing device, forming an electrostatic latent image on the surface of the OPC drum. Next, toner is supplied from the developing roller and attracted to the surface of the OPC drum by the electric field remaining on the surface of the OPC drum so that the electrostatic latent image on the OPC drum is changed into a toner image. The toner image is then transferred to paper passing between the OPC drum and the transferring roller by means of a bias voltage of the transferring roller when the OPC drum is rotated, and then the toner is fused to the paper by heat and pressure of a fusing device.

The charging performance of the charging roller depends on ambient temperature and humidity of the electrophotographic image forming device, pressure between the OPC drum and the charging roller, and characteristics of the OPC drum that change as the OPC drum is driven for a long time. These factors may bring about a difference in the potential charge on the surface of the OPC drum such that the charge is not uniform, thereby resulting in a printed image of poor quality.

In order to provide a uniform charge on a drum in an electrophotographic imaging device U.S. Pat. No. 5,420,671 to Hiroki Kisu et al. entitled Charger And Image Forming Apparatus With Same describes a process and apparatus for detecting a ground current from the drum and developing an AC sine wave in response to the detected current, and the AC sine wave is then superimposed on a DC voltage to charge a charging roller. The foregoing device, however, needs a source of AC power in addition to a source of DC power for superimposing the AC voltage on the DC voltage, thus increasing the device's cost. Additionally, a large amount of AC current wasted thereby increasing the device's operating cost, but also contributing to generation of unwanted ozone.

SUMMARY OF THE INVENTION

It is therefore an object of the present invention is to improve the quality of the printed image by controlling a charge voltage of an OPC drum while overcoming the problems associated with the prior art.

To accomplish this object, according to one aspect of the present invention, a method is provided, which comprises the steps of measuring a ground current of the OPC drum; comparing the measured ground current to a preset value; deriving an optimum voltage for charging the OPC drum based on the comparison result; and supplying said optimum charge voltage to the OPC drum.

To accomplish this object, according to another aspect of the present invention, an apparatus is provided, which comprises a detector for measuring a ground current flowing through a ground of the OPC drum; a comparator for comparing the measured ground current to a preset value; and a controller for deriving an optimum voltage for charging the OPC drum based on the comparison result.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same components, wherein.

DETAILED DESCRIPTION OF THE INVENTION

Figure 1:
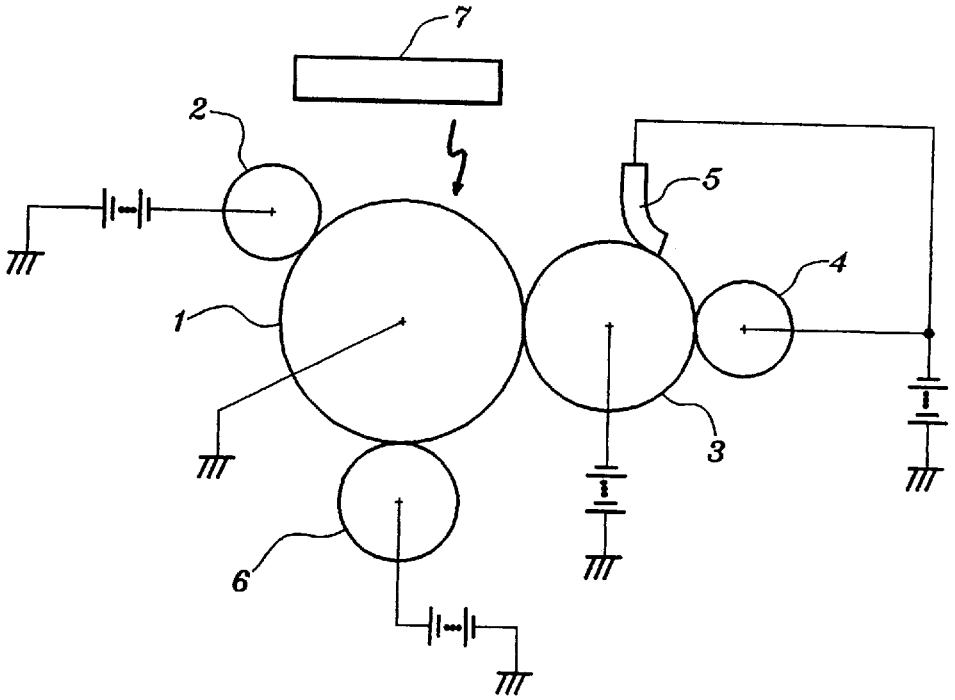
FIG. 1 shows a scheme of an exemplary electrophotographic image forming device.

Hereinafter, the present invention is described in detail with reference to appending drawings, wherein parts similar to those previously described in FIG. 1 are denoted by the same reference numerals.

An exemplary electrophotographic image forming device using the contact charging method is shown in FIG. 1, wherein an OPC drum I is rotatably arranged and image forming units are arranged around the OPC drum 1.

The image forming units include a charging roller 2 for charging the surface of the OPC drum 1 uniformly with a high negative voltage; an exposing device 7 for applying light from an LED (light emitting diode), or a laser diode, to the charged surface of OPC drum 1 for forming an electrostatic latent image; a developing roller 3 arranged to be in rotatable contact with OPC drum 1 for supplying toner to the electrostatic latent image to form a toner image on the surface of OPC drum 1; a toner supply roller 4 for supplying the toner to developing roller 3; a blade 5 for uniformly restricting the amount of toner deposited in a layer on developing roller 3; and a transfer roller 6 arranged to be in rotatable contact with OPC drum 1 for transferring the toner image to paper. These respective units are arranged around the OPC drum 1 in the order as mentioned in the above.

The electrophotographic image forming device of FIG. 1 would then operate on the basis of the following principle. When a voltage of for example, −1.35 to −1.45 KV is supplied to a rotational shaft of charging roller 2 in contact with OPC drum 1, an electric field is formed between the OPC drum 1 and the charging roller 2, thereby inducing an electric charge on the peripheral surface of OPC drum 1. The charged area of OPC drum 1 is then erased partially by light radiated from exposing device 7, forming an electrostatic latent image on the surface of OPC drum 1. Toner supply roller 4 then supplies toner to developing roller 3 and blade 5 restricts the toner-deposited layer on developing roller 3 to form a uniformly deposited layer. The formed toner layer is then attracted to the surface of OPC drum 1 by the electrostatic latent image on OPC drum 1, so that the electrostatic latent image is changed into a visible toner image. The toner image is next transferred to paper passing between OPC drum 1 and transfer roller 6 by means of a bias voltage applied to transfer roller 6 as OPC drum 1 is rotated, the toner image is then and fused by the heat and pressure of a fusing device (not shown) to the paper.

The charging performance of charging roller 2 depends on ambient temperature and humidity of the electrophotographic image forming device, pressure on OPC drum 1 applied from charging roller 2, tolerances of OPC drum 1 during its production, and characteristic of the OPC drum 1 that are subject to decrease in charge as OPC drum 1 is driven for a long time. These factors may bring a difference of the potential in the charged area on the surface of the OPC drum 1, i.e. the charge of the peripheral surface of the OPC drum 1 is not uniform, thereby reducing the quality of the printed image.

Figure 2:
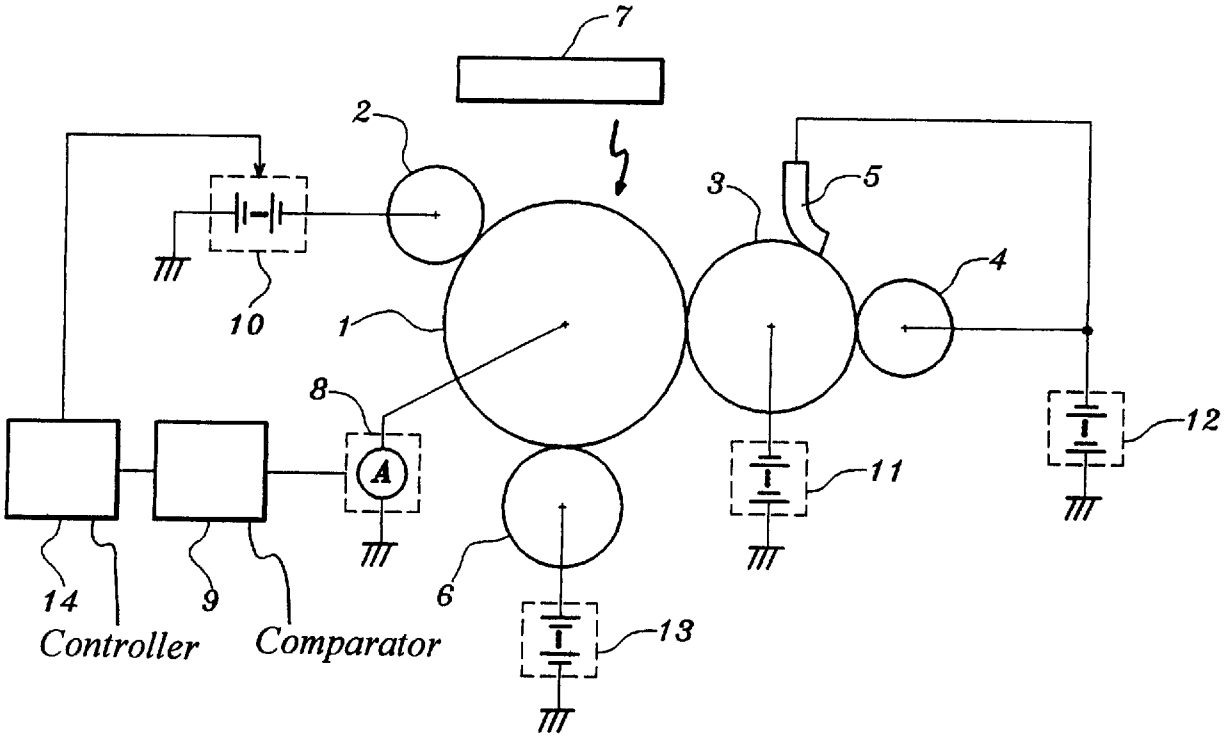
FIG. 2 shows a scheme of an electrophotographic image forming device according to the principles of the present invention.

FIG. 2 illustrates a scheme of the electrophotographic image forming device of the present invention, which shows a charging roller 2 connected to a voltage supplier 10, an OPC drum 1 connected to a detector 8, a comparator 9 connected to detector 8 and a controller 14 disposed between voltage supplier 10 and comparator 9. A transferring roller 6 is connected to a voltage supplier 13 and a developing roller 3 is connected to a voltage supplier 11. A toner supply roller 4 is connected to a voltage supplier 12.

In such construction, after the voltage is supplied to charging roller 2 from voltage supplier 10, during which developing roller 3, toner supply roller 4, blade 5, transferring roller 6 and the other parameters are all off, the initial charge on OPC drum 1 is carried out in such a manner that the surface of OPC drum 1 in contact with charging roller 2 is charged as a result of their associated rotational movement. OPC drum 1 continues to rotate and is then subjected to the light from exposing device 7 for a given time. The surface charged area of OPC drum 1, has an increased potential after being exposed to the light, generating a ground current corresponding to the potential difference between the initial charging-originated potential and the exposing-originated potential. The thus formed ground current flows through the ground of OPC drum 1 and is proportional to the potential difference.

Figure 3:
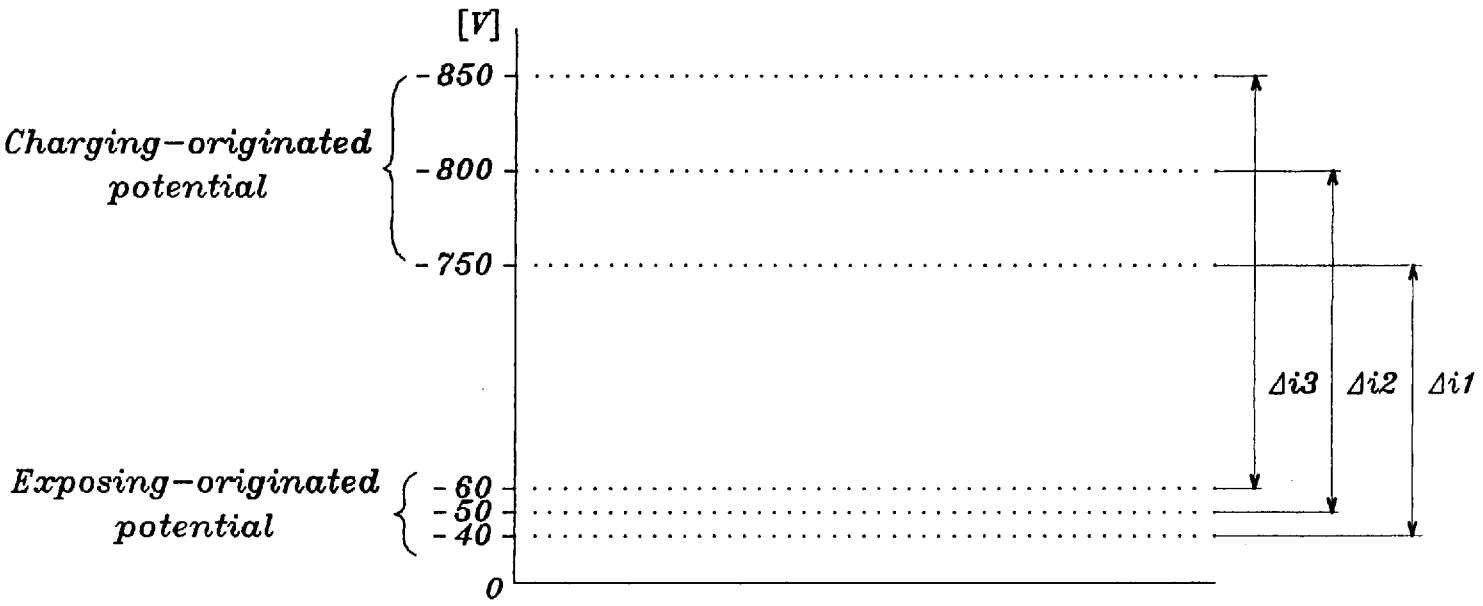
FIG. 3 is a view for illustrating the principle of deriving ground current corresponding to the potential difference between the initial charging-originated potential and the exposing-originated potential according to the principles of the present invention.
Figure 4:
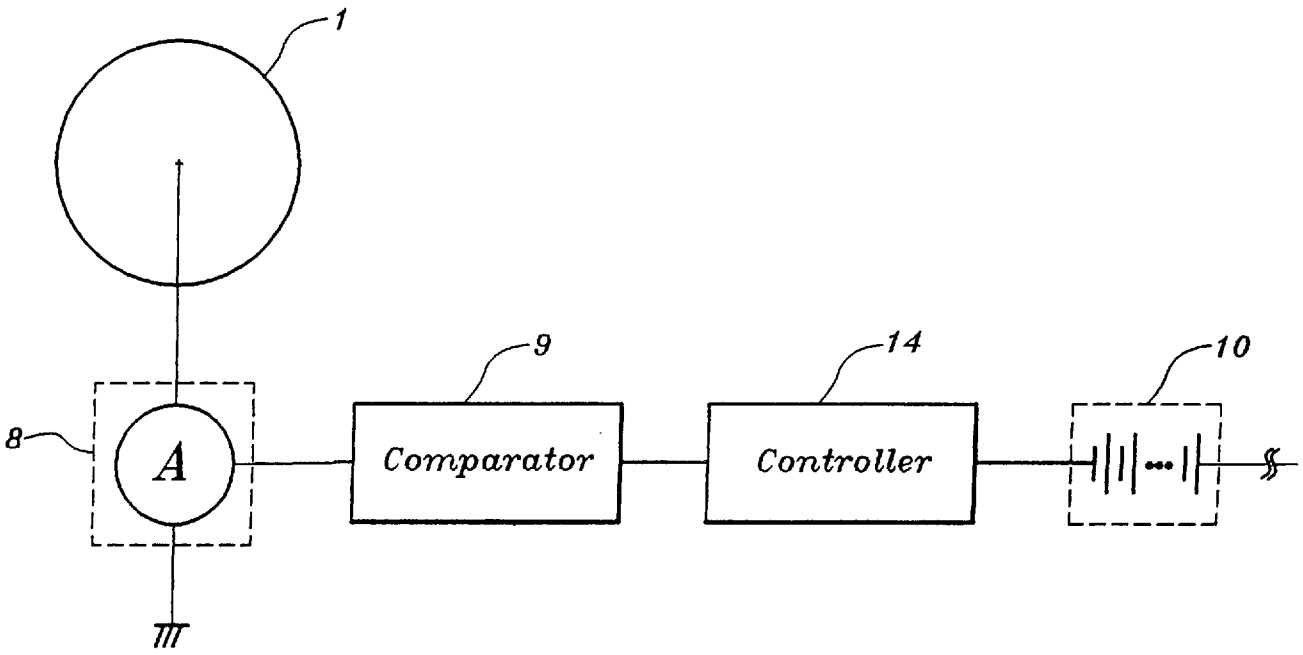
FIG. 4 shows a block diagram of a system for controlling the charge voltage by detecting the ground voltage of the electrophotographic image forming device according to the principles of the present invention.

FIG. 3 illustrates the principle of producing a ground current corresponding to the potential difference between an initial charging-originated potential and an exposing-originated potential. When OPC drum 1 has a reference potential of −800 V, as its optimum potential after an initial charging step, the potential after an exposing step is up to −50 V, thereby producing a ground current $\Delta i2$ flowing through the ground line which is dependent on the potential difference between the reference potential and the potential after exposing. The potential difference of the charging roller itself and ambient conditions such as temperature, humidity or the like, however, do not permit OPC drum 1 to be charged uniformly with the reference potential of −800 V. For example, the potential of OPC drum 1 may become −850 V after a next charging step due to the ambient conditions, and the potential after exposure may become −60 V, deriving a ground current $\Delta i3$ which is larger than $\Delta i2$. Similarly, the potential of OPC drum 1 may drop to −750 V after a next charging step due to the ambient conditions, and the potential after exposure may become −40 V, producing a ground current $\Delta i1$ which is smaller than $\Delta i2$.

It is possible to find the voltage of the charged OPC drum 1 by measuring the ground current flowing through the ground line. Therefore, the ground of OPC drum 1 is provided with a detector 8 to measure the ground current. The ground current value measured by detector 8 is input to a comparator 9. Comparator 9 is provided with a microcomputer (not shown) which includes a ROM and a RAM (not shown) in which the preset ground currents, charging potentials and exposing potentials are configured in the form of a table. Comparator 9 compares the ground current value to the stored preset current values, and then finds the voltage of OPC drum 1 with the predetermined voltage-related information stored as table values. For example, the detected voltage of the above-mentioned current $\Delta i2$, i.e., the ground current produced by the potential difference between the reference charging potential of OPC drum 1, is −800 V, and the exposing-originated potential is −50 V.

When the apparatus is first operated to perform a copying operation, charging roller 2 charges OPC drum 1 with a reference charging potential according to a preset voltage, for example −800 V, which may be desirably the optimum charge potential. As OPC drum rotates, it is exposed by light from exposing device 7 thus creating an exposing potential of −50 V. Detector 8 detects the ground current, which, according to the difference between the −800 V charging potential and the −50 V exposing potential is Δi2. Comparator 9 then detects the voltage presently charging the OPC drum 1 by means of the detected ground current, by looking up the values stored in the table corresponding to the detected ground current. Comparator 9 then compares the detected voltage to the preset voltage used to initially charge OPC drum 1 to the reference charging potential.

Controller 14 controls voltage supplier 10 according to the result of the comparison between the detected voltage and the preset voltage. When the detected current is Δi2, the detected voltage is −800 V, which is compared to the preset voltage of −800 V and controller 14 will not change the voltage output by voltage supplier 10. When the detected voltage is greater than the preset voltage, controller 14 controls voltage supplier 10 to lower the voltage supplied to charging roller 2. When the detected voltage is lower than the preset voltage, controller 14 controls voltage supplier 10 to raise the voltage supplied to charging roller 2. Accordingly, controller 14 establishes the optimum voltage through a result of comparison.

Controller 14 determines the optimum voltage for charging roller 2 based on the resultant value output from comparator 9, and controls the charge voltage of voltage supplier 10 in order to supply the optimum voltage to OPC drum 1, thereby minimizing the non-uniform potential of OPC drum 1 and charging roller 2, or the potential difference of OPC drum 1.

As mentioned above, this invention charges the surface of OPC drum 1 uniformly independently of the voltage difference between the respective parts thereof, tolerance of the circuits and ambient condition such as temperature, humidity and the others, thereby improving the quality of the image.

While the present invention has been described with reference to a specific embodiment, the description is illustrative of the invention and is not to be constructed as limiting the invention. Various modifications may occur to those skilled in the art without departing from the true spirit and scope of the invention as defined by the appended claims. For example, additional sensors can be provided which detect environmental information, such as ambient temperature and humidity, to determine the condition for the image transferring step. More in detail, in such a case, the comparator 9 would compare the circumstance information inputted from the sensors, in addition to the ground current input from detector 8, with the preset voltage and circumstance-related information in comparator 9, determine the optimum potential for charging OPC drum 1 as a result of the comparison, and transmit the resultant to controller 14 to control the voltage applied to charging roller 2 and/or the voltage applied to transferring roller 6.

What is claimed is:

1. A method for controlling a charge voltage of an organic photoconductive (OPC) drum in an electrophotographic image forming device to be maintained uniformly at an optimum value, the method comprising steps of:

measuring a ground current of said OPC drum;

comparing said measured ground current to preset current values stored in a table;

deriving an optimum voltage for charging said OPC drum based on a result of said comparing step; and supplying said optimum voltage to said OPC drum.

2. The method as set forth in claim 1, wherein said step of deriving an optimum voltage comprises the steps of:

selecting from said table a detected voltage based on said result of said comparing step;

comparing said detected voltage with a preset voltage; and deriving said optimum voltage based on a result of said step of comparing said detected voltage with said preset voltage.

3. The method as set forth in claim 1, further comprising the steps of controlling a voltage supply of a charging roller based on said optimum voltage; and charging said OPC drum uniformly to said optimum value by rotating said charging roller in contact with said OPC drum.

4. The method as set forth in claim 2, wherein said step of deriving said optimum voltage comprises the steps of:

controlling a voltage supply of a charging roller based on said result of said step of comparing said detected voltage with said preset voltage; and charging said OPC drum uniformly to said optimum value by rotating said charging roller in contact with said OPC drum.

5. The method as set forth in claim 3, wherein said step of controlling said voltage supply of said charging roller comprises a step of increasing said voltage supply when said detected voltage is lower than said preset voltage.

6. The method as set forth in claim 3, wherein said step of controlling said voltage supply of said charging roller comprises a step of decreasing said voltage supply when said detected voltage is higher than said preset voltage.

7. An apparatus for controlling a charge voltage of an organic photoconductive (OPC) drum in an electrophotographic image forming device to be maintained uniformly at an optimum value, said apparatus comprising:

means for measuring a ground current flowing through a ground of said OPC drum;

means for storing preset current values and corresponding voltage related information;

means for comparing said measured ground current to said preset current values for reading out said corresponding voltage related information as a detected voltage;

means for comparing said detected voltage to a preset voltage; and means for deriving an optimum voltage for charging said OPC drum based on [the] a result of comparing said detected voltage to said preset voltage.

8. The apparatus as set forth in claim 7, said apparatus further comprising:

a voltage supplier for generating said optimum voltage; and a charging roller for charging said OPC drum according to said optimum voltage.

9. The apparatus as set forth in claim 7, wherein said means for measuring a ground current comprises a ground current detector.

10. The apparatus as set forth in claim 7, said apparatus comprising a microcomputer, said microcomputer comprising:

said means for storing preset current values and corresponding voltage related information;

said means for comparing said measured ground current to said preset current values; and said means for comparing said detected voltage to said preset voltage.

11. The apparatus as set forth in claim 8, wherein said means for deriving said optimum voltage comprises a controller for controlling said voltage supplier according to said result of comparing said detected voltage to said preset voltage.

12. The apparatus as set forth in claim 11, wherein said controller decreases a voltage supply of said voltage supplier when said detected voltage is higher than said preset voltage.

13. The apparatus as set forth in claim 11, wherein said controller increases a voltage supply of said voltage supplier when said detected voltage is lower than said preset voltage.

14. A method for controlling a charge voltage of an organic photoconductive (OPC) drum in an electrophotographic image forming device to be maintained uniformly at an optimum charging potential, the method comprising steps of:

charging a peripheral surface of said OPC drum to a reference charging potential according to a preset voltage;

exposing said OPC drum to light from an exposing device to establish an electrostatic latent image on a portion of said peripheral surface of said OPC drum, said portion having an exposed potential greater than said reference charging potential;

generating a ground current corresponding to a difference between said reference charging potential and said exposed potential;

measuring said ground current corresponding to said difference between said reference charging potential and said exposed potential;

comparing said measured ground current to preset current values stored in a table;

deriving an optimum voltage for charging said OPC drum based on a result of said comparing step; and charging said peripheral surface of said OPC drum to said optimum charging potential according to said optimum voltage.

15. The method as set forth in claim 14, wherein said step of deriving an optimum voltage comprises the steps of:

selecting from said table a detected voltage based on said result of said comparing step;

comparing said detected voltage with said preset voltage;

controlling a voltage supply of a charging roller based on a result of said step of comparing said detected voltage with said preset voltage; and charging said OPC drum uniformly to said optimum charging potential by rotating said charging roller in contact with said OPC drum.

16. The method as set forth in claim 15, wherein said step of controlling said voltage supply of said charging roller comprises a step of increasing said voltage supply when said detected voltage is lower than said preset voltage.

17. The method as set forth in claim 15, wherein said step of controlling said voltage supply of said charging roller comprises a step of decreasing said voltage supply when said detected voltage is higher than said preset voltage.

* * * * *